US009261303B2

(12) United States Patent
Jeong et al.

(10) Patent No.: US 9,261,303 B2
(45) Date of Patent: Feb. 16, 2016

(54) ICE-MAKING UNIT AND REFRIGERATOR HAVING THE SAME

(75) Inventors: Jin Jeong, Yongin-si (KR); Young Shik Shin, Seongnam-si (KR); Sang Hyun Park, Seongnam-si (KR); Qasim Khan, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1467 days.

(21) Appl. No.: 12/662,229

(22) Filed: Apr. 6, 2010

(65) Prior Publication Data

US 2010/0319373 A1 Dec. 23, 2010

(30) Foreign Application Priority Data

Jun. 23, 2009 (KR) ..... 10-2009-0055778

(51) Int. Cl.
*F25C 1/22* (2006.01)
*F25C 1/08* (2006.01)
*F25C 5/00* (2006.01)

(52) U.S. Cl.
CPC . *F25C 1/08* (2013.01); *F25C 5/005* (2013.01); *F25C 2305/022* (2013.01)

(58) Field of Classification Search
CPC ..... F25C 1/04; F25C 1/225; F25C 2400/14; F25C 1/12; F25C 2400/10; F25C 1/24; F25C 5/185; F25C 1/10; F25C 1/125; F25C 1/142; F25C 5/005
USPC ..... 62/340, 344, 345, 346, 459, 460, 448, 62/463, 465
See application file for complete search history.

(56) References Cited

U.S. PATENT DOCUMENTS

| | | | | | |
|---|---|---|---|---|---|
| 3,418,823 | A | * | 12/1968 | Salimbeni Vivai | 62/138 |
| 3,433,030 | A | * | 3/1969 | Jacobs | 62/347 |
| 3,526,100 | A | * | 9/1970 | Briel | 62/340 |
| 3,581,516 | A | * | 6/1971 | Buchser et al. | 62/137 |
| 3,791,166 | A | * | 2/1974 | Maleck | 62/138 |
| 4,184,339 | A | * | 1/1980 | Wessa | 62/68 |
| 4,199,956 | A | * | 4/1980 | Lunde | 62/138 |
| 4,344,298 | A | * | 8/1982 | Biemiller | 62/347 |
| 4,685,304 | A | * | 8/1987 | Essig | 62/68 |

(Continued)

FOREIGN PATENT DOCUMENTS

| | | | | |
|---|---|---|---|---|
| CN | 101231054 | | 7/2008 | |
| JP | 03158669 | A * | 7/1991 | F25C 1/18 |

(Continued)

OTHER PUBLICATIONS

Chinese Office Action for corresponding Chinese Application No. 201010171063.5; issued Nov. 19, 2013.

(Continued)

*Primary Examiner* — Ljiljana Ciric
(74) *Attorney, Agent, or Firm* — Staas & Halsey LLP

(57) ABSTRACT

An ice-making unit, which uses a cooling unit in which a refrigerant pipe is received, and a refrigerator having the same. The cooling unit includes a cooler for conduction of coldness, an inner surface of the cooler coming into direct contact with the refrigerant pipe, realizing a direct cooling type ice making operation. A rotatable tray is provided under the cooling unit, so that an ice-separating member attached to the cooling unit pushes ice upon rotation of the tray, allowing the ice to be discharged in a direction opposite to the rotating direction of the tray.

22 Claims, 8 Drawing Sheets

(56) References Cited

U.S. PATENT DOCUMENTS

| | | | | | |
|---|---|---|---|---|---|
| 4,727,720 | A * | 3/1988 | Wernicki | 62/3.63 |
| 4,756,165 | A * | 7/1988 | Chestnut et al. | 62/135 |
| 4,852,359 | A * | 8/1989 | Manzotti | 62/68 |
| 4,942,742 | A * | 7/1990 | Burruel | 62/347 |
| 5,127,236 | A * | 7/1992 | von Blanquet | 62/351 |
| 5,160,094 | A * | 11/1992 | Willis et al. | 62/137 |
| 5,261,248 | A * | 11/1993 | Willis et al. | 62/137 |
| 5,329,786 | A * | 7/1994 | Willis et al. | 62/353 |
| 5,809,797 | A * | 9/1998 | Ryu | 62/340 |
| 6,112,540 | A * | 9/2000 | Serrels et al. | 62/351 |
| 6,145,320 | A * | 11/2000 | Kim | 62/6 |
| 6,349,550 | B1 * | 2/2002 | Shapiro et al. | 62/233 |
| 6,393,859 | B1 * | 5/2002 | Olsson et al. | 62/345 |
| 6,647,739 | B1 * | 11/2003 | Kim et al. | 62/352 |
| 6,688,131 | B1 * | 2/2004 | Kim et al. | 62/353 |
| 6,698,228 | B2 * | 3/2004 | Kateman et al. | 62/346 |
| 6,742,351 | B2 * | 6/2004 | Kim et al. | 62/352 |
| 6,920,764 | B2 * | 7/2005 | Zevlakis | 62/73 |
| 7,017,354 | B2 * | 3/2006 | Lee et al. | 62/73 |
| 7,059,140 | B2 * | 6/2006 | Zevlakis | 62/66 |
| 7,100,379 | B2 * | 9/2006 | Son et al. | 62/74 |
| 7,111,473 | B2 * | 9/2006 | Chung et al. | 62/320 |
| 7,201,014 | B2 * | 4/2007 | Hornung | 62/347 |
| 7,216,491 | B2 * | 5/2007 | Cole et al. | 62/74 |
| 7,216,499 | B2 * | 5/2007 | Flinner et al. | 62/233 |
| 7,373,789 | B2 * | 5/2008 | Oh et al. | 62/320 |
| 7,487,645 | B2 * | 2/2009 | Sasaki et al. | 62/135 |
| 7,617,699 | B1 * | 11/2009 | Parmely | 62/476 |
| 7,703,300 | B2 * | 4/2010 | Petrenko | 62/351 |
| 8,099,975 | B2 * | 1/2012 | Rafalovich et al. | 62/434 |
| 8,104,304 | B2 * | 1/2012 | Kang et al. | 62/344 |
| 8,132,424 | B2 * | 3/2012 | Burn | 62/345 |
| 8,336,330 | B2 * | 12/2012 | Lee et al. | 62/442 |
| 8,402,782 | B2 * | 3/2013 | Kim et al. | 62/353 |
| 8,402,783 | B2 * | 3/2013 | Kim et al. | 62/353 |
| 8,408,023 | B2 * | 4/2013 | Shin et al. | 62/349 |
| 8,443,619 | B2 * | 5/2013 | Cho | 62/345 |
| 8,443,621 | B2 * | 5/2013 | Shin et al. | 62/350 |
| 8,448,462 | B2 * | 5/2013 | Shin et al. | 62/425 |
| 8,453,475 | B2 * | 6/2013 | Shin et al. | 62/351 |
| 8,459,047 | B2 * | 6/2013 | Hall et al. | 62/66 |
| 8,459,057 | B2 * | 6/2013 | Kim et al. | 62/344 |
| 8,484,987 | B2 * | 7/2013 | Ducharme et al. | 62/138 |
| 8,499,572 | B2 * | 8/2013 | Lim et al. | 62/137 |
| 8,516,844 | B2 * | 8/2013 | Kim et al. | 62/344 |
| 8,528,351 | B2 * | 9/2013 | An et al. | 62/137 |
| 8,904,816 | B2 * | 12/2014 | Bergqvist et al. | 62/345 |
| 9,021,827 | B2 * | 5/2015 | Lee | 62/344 |
| 2004/0107721 | A1 * | 6/2004 | Choi et al. | 62/340 |
| 2006/0117784 | A1 * | 6/2006 | Yang | 62/340 |
| 2006/0242971 | A1 * | 11/2006 | Cole et al. | 62/66 |
| 2007/0103940 | A1 * | 5/2007 | Chung | 62/137 |
| 2007/0163282 | A1 * | 7/2007 | Cushman et al. | 62/340 |
| 2008/0156000 | A1 * | 7/2008 | Shin et al. | 62/340 |
| 2008/0156001 | A1 * | 7/2008 | Lee et al. | 62/74 |
| 2009/0165492 | A1 * | 7/2009 | Wilson et al. | 62/344 |
| 2009/0211266 | A1 * | 8/2009 | Kim et al. | 62/66 |
| 2010/0064716 | A1 * | 3/2010 | Park | 62/340 |
| 2010/0139295 | A1 * | 6/2010 | Zuccolo et al. | 62/345 |
| 2010/0175398 | A1 * | 7/2010 | Lim et al. | 62/344 |
| 2011/0048045 | A1 * | 3/2011 | An et al. | 62/347 |
| 2013/0098097 | A1 * | 4/2013 | Lee et al. | 62/340 |
| 2013/0160480 | A1 * | 6/2013 | Athanasiou et al. | 62/340 |
| 2013/0174599 | A1 * | 7/2013 | Jeong et al. | 62/344 |
| 2013/0227983 | A1 * | 9/2013 | Jeong et al. | 62/285 |

FOREIGN PATENT DOCUMENTS

| | | | | |
|---|---|---|---|---|
| JP | 03158674 | A * | 7/1991 | F25C 1/18 |
| JP | 03158675 | A * | 7/1991 | F25C 1/18 |
| JP | 2008-275223 | | 11/2008 | |
| KR | 10-2004-0039092 | | 5/2004 | |
| KR | 10-2004-0085282 | | 10/2004 | |
| KR | 10-2004-0085606 | | 10/2004 | |
| KR | 10-2004-0087057 | | 10/2004 | |
| KR | 10-2006-0029864 | | 4/2006 | |

OTHER PUBLICATIONS

Korean Office Action issued Apr. 14, 2015 in corresponding Korean Patent Application No. 10-2009-0055778.

* cited by examiner

ICE-MAKING UNIT AND REFRIGERATOR HAVING THE SAME

CROSS-REFERENCE TO RELATED APPLICATION

This application claims the benefit of Korean Patent Application No. 2009-0055778, filed on Jun. 23, 2009 in the Korean Intellectual Property Office, the disclosure of which is incorporated herein by reference.

BACKGROUND

1. Field

Embodiments relate to a refrigerator including a direct-cooling type ice-making unit, which may enhance ice making performance and reduce energy loss caused during an ice making operation.

2. Description of the Related Art

Generally, a refrigerator includes a refrigerating compartment and a freezing compartment, which are separated from each other for optimum fresh storage of a variety of foods for a long time. The refrigerating compartment serves to keep food, such as vegetables, fruits, etc., at a temperature slightly above freezing. The freezing compartment serves to keep food, such as meats, fishes, etc., at a freezing temperature or less.

An icemaker is installed in the freezing compartment and serves to freeze water into ice using cold air that circulates in the freezing compartment.

The icemaker includes a tray in which water is frozen into ice, and a storage container for storage of ice.

Icemakers may be classified, based on ice making methods thereof, into an indirect cooling type icemaker, a tray of which is cooled by forcible convection of cold air supplied thereto so that water received in the tray is frozen into ice, and a direct cooling type icemaker. The direct cooling type includes a tray. Either the tray, or water received in the tray, comes into direct contact with a refrigerant pipe for ice making. Generally, an automatic icemaker for a domestic refrigerator is of an indirect cooling type, in which water supply, ice making, and ice separating operations are automatically carried out based on a temperature of a tray.

The above-described indirect cooling type icemaker adopts a relatively simple ice separating mechanism, simplified convenient cooling method, and easy manufacture thereof. However, due to the use of a high capacity heater for an ice separating operation, this type of icemaker may consume substantial electricity and increase the temperature of an ice-making chamber or a freezing compartment. Furthermore, the indirect cooling type icemaker may have low efficiency and tardy ice-making speed because cold air produced via heat exchange of an evaporator is forcibly circulated to cool the tray via operation of a blower fan.

SUMMARY

Therefore, it is an aspect to provide an ice-making unit to achieve enhanced ice-making performance and reduced energy loss during an ice making operation and a refrigerator having the same.

Additional aspects will be set forth in part in the description which follows and, in part, will be apparent from the description, or may be learned by practice of the invention.

The foregoing and/or aspects are achieved by providing an ice-making unit including a refrigerant pipe through which a refrigerant moves, a cooling unit in which at least a part of the refrigerant pipe is received, and a tray having a receiving region in which water or ice is received, at least a part of the cooling unit being placed in the receiving region to come into contact with the water received in the tray so as to freeze the water into ice.

The cooling unit may include a case defining an external appearance of the cooling unit and a cooler to conduct coldness to the receiving region, and an inner surface of the cooler may come into direct contact with the refrigerant pipe arranged inside the cooler.

The cooler may be located at a lower end of the cooling unit, and the tray may be located under the cooler.

The refrigerant pipe arranged in the cooling unit may be wound into multiple layers to circulate the interior of the cooling unit.

The refrigerant pipe arranged in the cooling unit may have a serpentine circulating pattern.

At least a part of the cooling unit may have a curvature. The cooler may contain at least one of highly thermally conductive metal and plastic. The metal may include at least one of aluminum and copper. The cooler may include a coating layer for easy separation of the ice.

The cooling unit may further include an ice-separating member provided at a side thereof to eject the ice. The cooling unit may be tilted from an imaginary vertical plane to a given direction.

The tray may be rotatably provided. The ice-separating member may be arranged to come into contact with the ice so as to push the ice by rotation of the tray, causing the ice to be discharged in a direction opposite to a rotating direction of the tray. A tilting angle of the cooling unit from the vertical plane may be in a range of about 30° to about 60°. A rotating angle of the tray may be in a range of about 0° to about 150°.

The receiving region may include a plurality of cubes divided by a plurality of partitions, and two of the cubes located at opposite distal ends of the receiving region may have narrower water receiving spaces than the other cubes.

The cooling unit may include a heater for easy separation of the ice.

The cooling unit may include a heat insulating material filled therein.

The ice-making unit may further include a tray motor to rotate the tray, and an ice-full lever to sense whether or not a storage container, in which the ice discharged from the ice-making unit is stored, is full of ice, and operation of the tray motor may be linked to operation of the ice-full lever.

The foregoing and/or other aspects may be achieved by providing a refrigerator including an ice-making unit to make ice, and an ice-making container in which the ice discharged from the ice-making unit is stored, the ice-making unit including a refrigerant pipe through which a refrigerant circulated by a refrigeration cycle moves, a cooling unit to surround a part of the refrigerant pipe, and a rotatable tray having a receiving region in which water or ice is received, a lower portion of the cooling unit being immersed in the water received in the receiving region to freeze the water into ice.

The lower portion of the cooling unit may contain at least one of highly thermally conductive metal and plastic.

The cooling unit may include a case defining an external appearance of the cooling unit and a cooler to conduct coldness to the receiving region, and the case may include an ice-separating member fixed to a side of the case to eject the ice.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
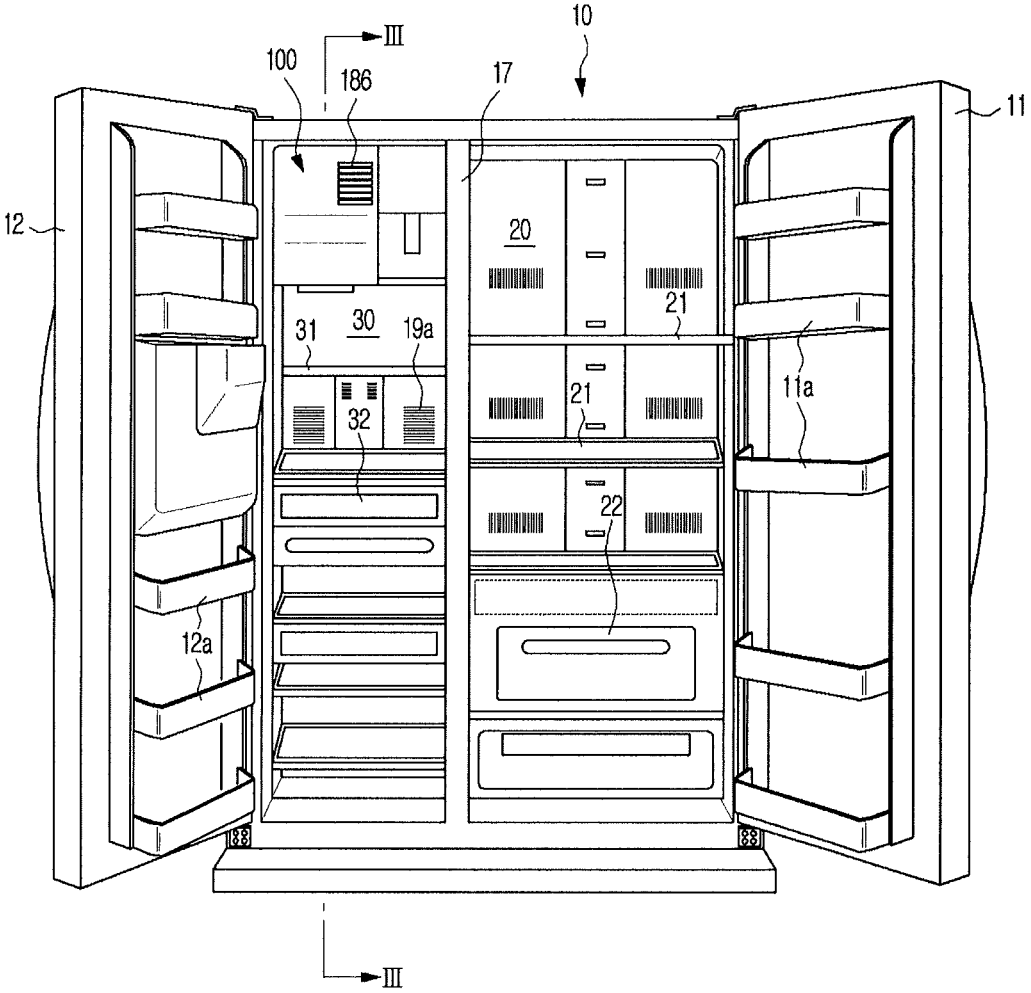
FIG. 1 is a perspective view illustrating an entire configuration of a refrigerator according to one embodiment.

Reference will now be made in detail to the embodiments, examples of which are illustrated in the accompanying drawings, wherein like reference numerals refer to like elements throughout.

Figure 2:
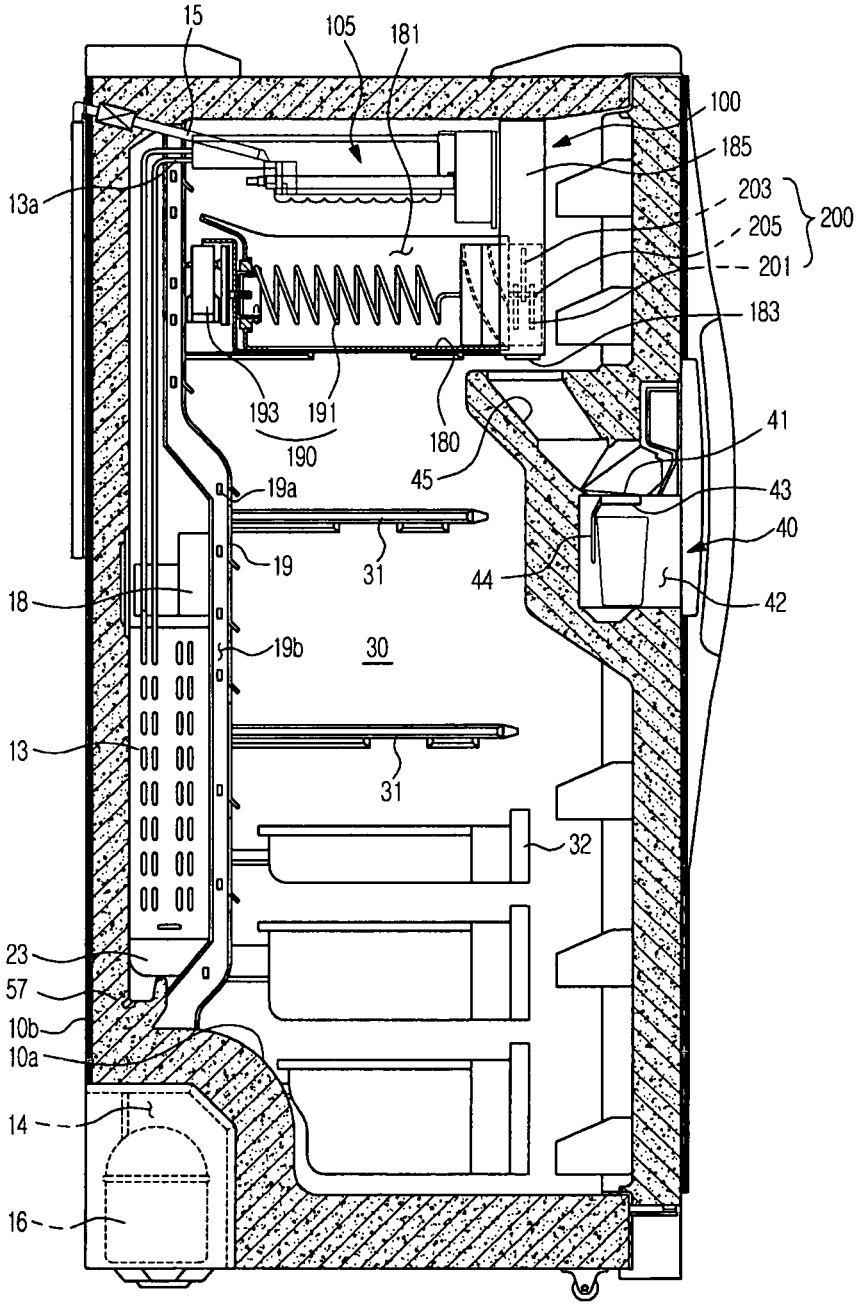
FIG. 2 is a side sectional view taken along the line of III-III of FIG. 1 illustrating a freezing compartment of the refrigerator according to the embodiment.

FIG. 1 is a perspective view illustrating a refrigerator according to one embodiment, and FIG. 2 is a side sectional view illustrating a freezing compartment of the refrigerator.

The refrigerator, as shown in FIGS. 1 and 2, includes a body 10 defining an external appearance of the refrigerator, storage compartments 20 and 30 defined vertically lengthwise in the body 10 and having open front sides, doors 11 and 12 to open or close the open front sides of the storage compartments 20 and 30, an icemaker 100 provided in one of the storage compartments 20 and 30, i.e. the freezing compartment 30, and a dispenser 40 to discharge ice made in the icemaker 100 to a front surface of the door 12 of the freezing compartment 30.

An evaporator 13 used to produce cold air is mounted to a rear wall of the body 10, and a machine room 14 is defined in a rear bottom region of the body 10. Also, a foam material 57 for heat insulation is filled between an outer shell 10*b* and an inner shell 10*a* of the body 10.

Electric elements, such as a compressor 16, etc., are arranged in the machine room 14 defined in the body 10. Both the storage compartments 20 and 30 are located above the machine room 14.

The body 10 also contains a variety of constituent elements of a refrigeration cycle, such as, e.g., a condenser (not shown) and an evaporator (not shown). To realize the refrigeration cycle, refrigerant circulates through the compressor 16, condenser, evaporator, and an ice-making unit 105 that will be described hereinafter.

The storage compartments 20 and 30 are horizontally separated from each other by a vertical partition 17. The refrigerating compartment 20, which is located at the right side of the drawing, preserves food in a refrigerated state, and the freezing compartment 30, which is located at the left side of the drawing, preserves food in a frozen state.

An inner panel 19 is erected in a rear region of the storage compartments 20 and 30, to define a cold air producing chamber 23 in which cold air to be supplied into the storage compartments 20 and 30 is produced. The evaporator 13 is arranged in the cold air producing chamber 23 and serves to produce cold air via heat exchange with air.

The inner panel 19 is perforated with a plurality of discharge holes 19*a* by predetermined intervals, to allow cold air to be uniformly distributed and discharged into the storage compartments 20 and 30. The inner panel 19 also defines a cold air path 19*b* to guide cold air to the discharge holes 19*a*. A circulating fan 18 is provided to blow cold air, which is heat-exchanged while passing through the evaporator 13, toward the cold air path 19*b* and discharge holes 19*a*.

The storage compartments 20 and 30 contain shelves 21 and 31 and storage boxes 22 and 32, for food storage.

A pair of the doors 11 and 12 is provided to open or close the refrigerating compartment 20 and freezing compartment 30, respectively. Specifically, the doors 11 and 12 include a refrigerating compartment door 11 rotatably coupled to the body 10 to open or close the refrigerating compartment 20, and the freezing compartment door 12 rotatably coupled to the body 10 to open or close the freezing compartment 30.

A plurality of door shelves 11*a* and 12*a* for food storage is provided at inner surfaces of the refrigerating compartment door 11 and freezing compartment door 12.

The dispenser 40 is provided at the freezing compartment door 12, to allow a user to discharge a substance, such as water or ice, without opening the door 12. The icemaker 100 is arranged in a top region of the freezing compartment 30 and serves to supply ice to the dispenser 40.

The dispenser 40 includes a discharge region 42 in the form of a space indented inward from the front surface of the freezing compartment door 12, a discharge opening 41 located at a side of the discharge region 42 for discharge of a substance therethrough, an opening/closing member 43 to open or close the discharge opening 41, an operating lever 44 arranged in the discharge region 42 and serving not only to operate the opening/closing member 43 but also to operate the icemaker 100 provided in the freezing compartment 30, and an ice discharge passage 45 extending from a rear surface to the front surface of the freezing compartment door 12 to guide ice from the icemaker 100 to the discharge opening 41.

The icemaker 100 provided in the top region of the freezing compartment 30 may include the ice-making unit 105 to make ice, a storage container 180 arranged under the ice-making unit 105, in which the ice made in the ice-making unit 105 is stored, a delivery unit 190 to deliver the ice stored in the storage container 180, and a crusher 200 in which the ice delivered from the delivery unit 190 is crushed into crushed ice.

The ice-making unit 105 will be described in detail hereinafter.

The storage container 180 is arranged under the ice-making unit 105. The storage container 180 includes a receiving region 181 extending lengthwise from the front to the rear and having an open upper side to receive ice falling from the ice-making unit 105, an ice outlet 183 perforated in a front bottom position thereof for discharge of ice, and a cover 185 coupled to a front end of the storage container 180 to cover a front side of the icemaker 100.

The storage container 180 takes the form of a drawer to be pushed into or pulled out of the freezing compartment 30. The cover 185 has vent holes 186 for interchange between cold air of the freezing compartment 30 and cold air of the icemaker 100.

The delivery unit 190 includes a spiral delivery member 191 and a delivery motor 193. The spiral delivery member 191 is rotatably installed in the storage container 180 and serves to deliver ice inside the discharge container 180 toward the ice outlet 183. The delivery motor 193 is secured at a rear position of the storage container 180 and serves to rotate the spiral delivery member 191. The spiral delivery member 191 is separated from a shaft of the delivery motor 193 when the storage container 180 is separated from the freezing compartment 30 and is coupled to the shaft of the delivery motor 193 when the storage container 180 is mounted into the freezing compartment 30.

The crusher 200 is located toward the ice outlet 183 in the storage container 180. The crusher 200, as shown in FIG. 2, includes a stator blade 201 kept at a fixed position near the ice outlet 183, and a plurality of rotator blades 203 installed to be rotated relative to the stator blade 201. The rotator blades 203 are coupled to a shaft 205 extending from the spiral delivery member 191 of the delivery unit 190. Thus, the rotator blades 203 of the crusher 200 are rotated when the spiral delivery member 191 is rotated by operation of the delivery motor 193.

The crusher 200 may further include a shutter (not shown), which is designed to partially close or open the ice outlet 183 for discharge of ice cubes or crushed ice. The configuration of the shutter is generally known and thus, illustration thereof in the drawings is omitted.

For example, the shutter may include an opening/closing member rotatably coupled to the ice outlet 183, a solenoid drive device to enable opening/closing operation of the opening/closing member, and a connecting member to connect the solenoid drive device and opening/closing member to each other.

Hereinafter, the ice-making unit 105 according to the embodiment will be described in detail with reference to the accompanying drawings.

Figure 3:
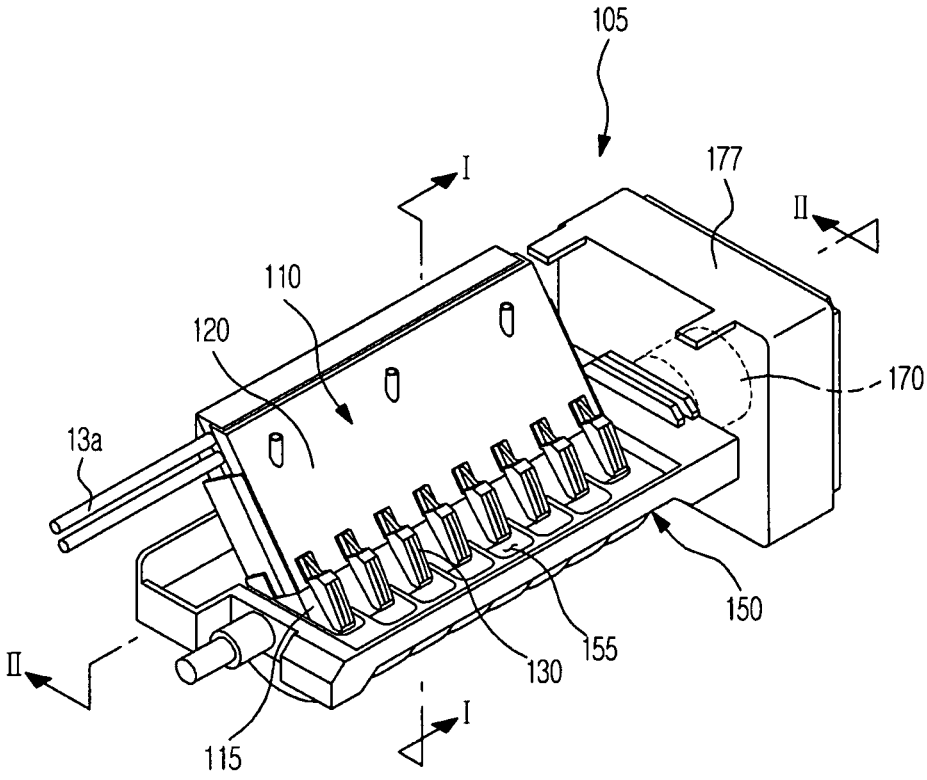
FIG. 3 is a perspective view illustrating an ice-making unit according to the embodiment.
Figure 4:
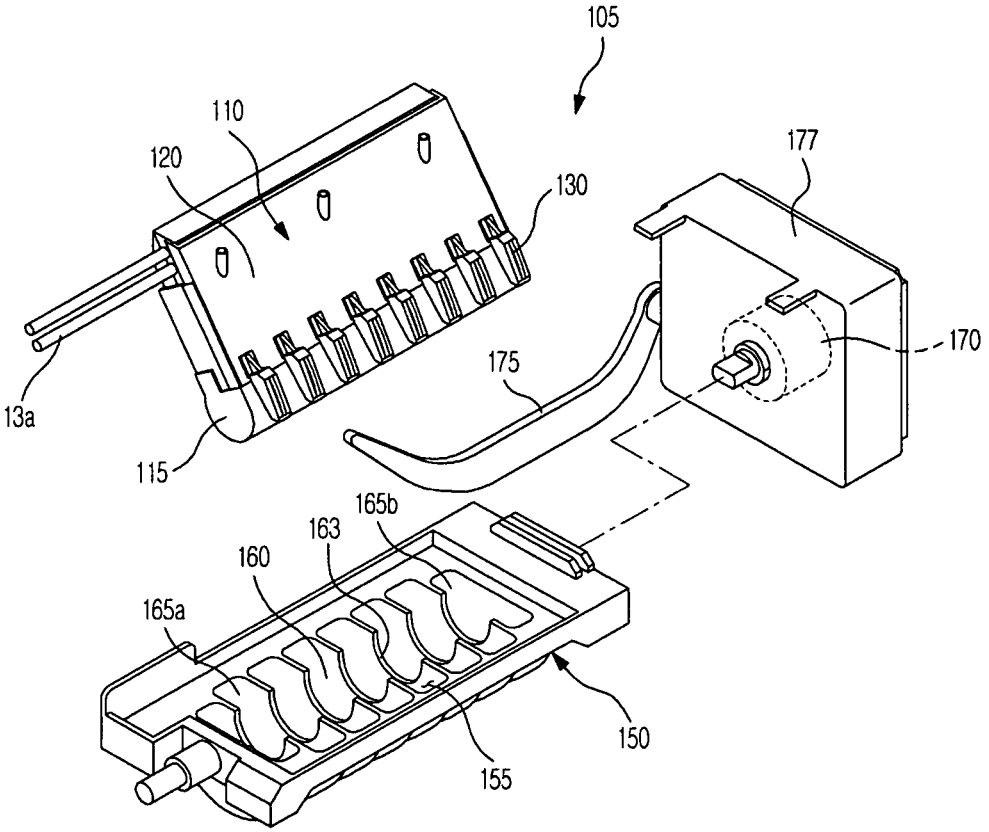
FIG. 4 is an exploded perspective view illustrating the ice-making unit of FIG. 3.
Figure 5:
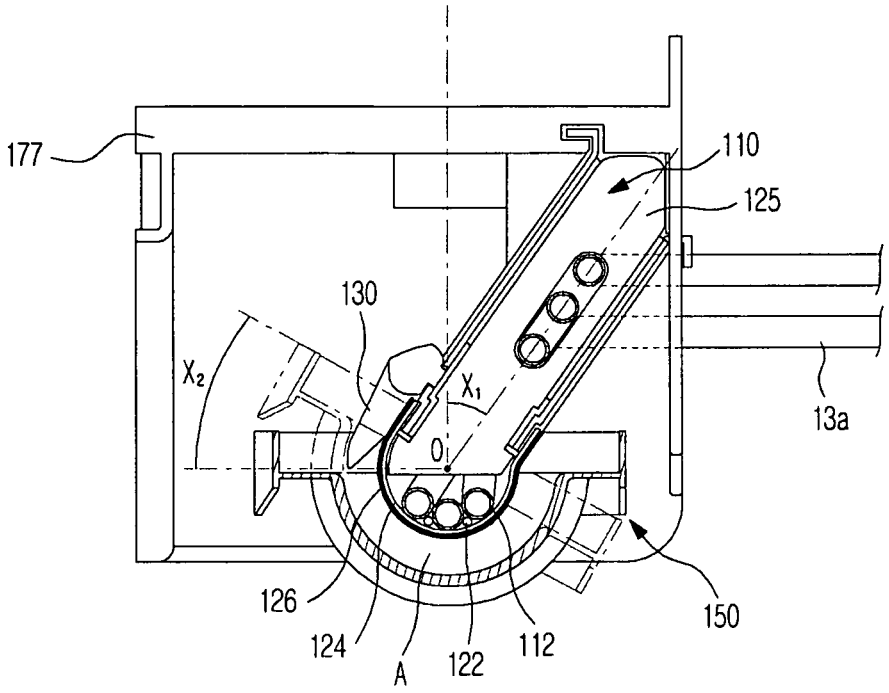
FIG. 5 is a sectional view taken along the line I-I of FIG. 3.
Figure 6:
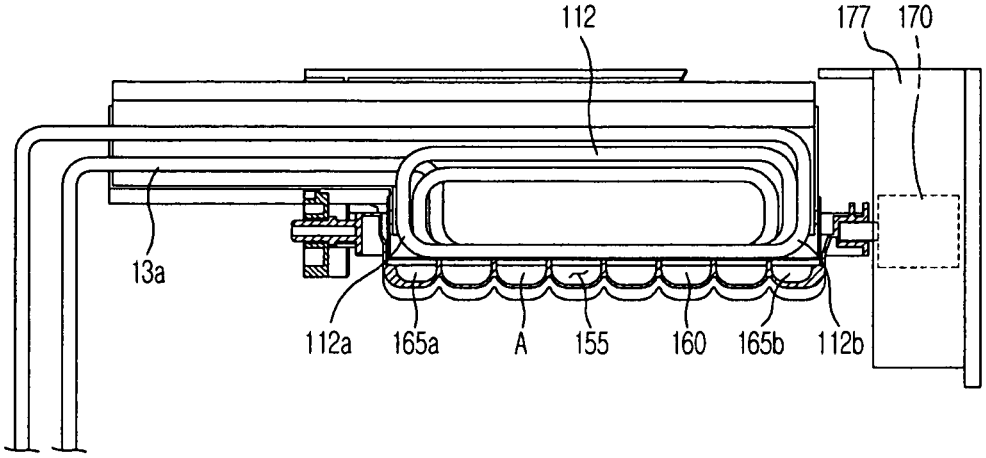
FIG. 6 is a sectional view taken along the line II-II of FIG. 3.

FIG. 3 is a perspective view illustrating the ice-making unit according to the embodiment, FIG. 4 is an exploded perspective view illustrating the ice-making unit of FIG. 3, FIG. 5 is a sectional view taken along the line I-I of FIG. 3, and FIG. 6 is a sectional view taken along the line II-II of FIG. 3.

As shown in FIGS. 3 to 6, the ice-making unit 105 includes a cooling unit 110 for ice making, a tray 150 located under the cooling unit 110, in which a receiving region 155 for storage of water or ice is defined, an ice-full lever 175 to sense whether or not the storage container 180 is full of ice, and a fixing member 177 to fixedly mount the ice-making unit 105 to the body 10.

The cooling unit 110 includes a case 120 defining an external appearance of the cooling unit 110, a cooler 115 provided at a lower end of the case 120 for conduction of coldness, and a plurality of ice-separating members 130 arranged on a side of the case 120 and serving to eject ice into the storage container 180. A refrigerant pipe 13*a* extending from the evaporator 13 is connected to an upper lateral position of the cooling unit 110.

The cooling unit 110, as shown in FIGS. 4 and 5, is tilted from an imaginary vertical plane by a predetermined angle X1 to the right side of the drawing. The refrigerant pipe 13*a* connected to the evaporator 13 penetrates through the cooling unit 110 to circulate the interior of the cooling unit 110.

The tilting angle X1 of the cooling unit 110 is in a range of 30° to 60° and more specifically, may be 45°. The reason for tilting the cooling unit 110 is to assist an ice discharge function of the ice-separating members 130 attached to the cooling unit 110 when ice is discharged by rotation of the tray 150, as will be described hereinafter.

The cooling unit 110 contains a single refrigerant pipe 112 therein. The refrigerant pipe 112 is wound into multiple layers and circulates throughout the interior of the cooling unit 110. Specifically, the refrigerant pipe 112 inside the cooler 115 comes into direct contact with the cooler 115 such that the wound layers of the refrigerant pipe 112 densely overlap one another. This arrangement is adopted to facilitate conduction of coldness via the cooler 115. A heat-insulating material 125 is filled in an interior region of the cooling unit 110, except for the region where the refrigerant pipe 112 is arranged.

The cooler 115 has a curvature, more particularly, a constant curvature. That is, the cooler 115 has a curved surface of a constant bending degree. In addition, the cooler 115 may have the same center of curvature O as the receiving region 155 that will be described hereinafter. Also, it may be effective to make the cooler 115 of a highly thermally conductive material, in order to enhance conduction efficiency of coldness. The cooler 115 contains highly thermally conductive metal or plastic and thus, may be made of aluminum or copper. In the embodiment, the cooler 115 may take the form of a curved aluminum plate 124.

A coating layer 126 may be provided on an outer surface of the cooler 115, to assure easy separation from ice A made in the tray 150.

Also, a heater 122 may be attached to an inner surface of the cooler 115, to facilitate easy separation of the ice A.

The tray 150 is rotatably provided at the bottom of the cooling unit 110. For rotation thereof, the tray 150 is connected to a tray motor 170 that is installed in the fixing member 177.

The tray 150 includes the receiving region 155 for storage of water or ice and in turn, the receiving region 155 is divided into a plurality of cubes 160 by a plurality of partitions 163. Although the term 'ice cubes' is used, it would be understood that this is a general term, and the formed ice does not necessarily have to be cubical. The receiving region 155 may have a curvature, more particularly, a constant curvature. The receiving region 155 has the same center of curvature O as the cooler 115 and this configuration serves to facilitate an ice separating operation by rotation of the tray 150.

A pair of cubes 165*a* and 165*b*, located at opposite distal ends of the receiving region 155, provides narrower water receiving spaces than the other cubes 160. As shown in FIG. 6, although the refrigerant pipe 112 comes into contact with the cooler 115, both distal portions 112*a* and 112*b* of the refrigerant pipe 112 are distant from a surface of the cooler 115, thus having reduction in conduction efficiency of coldness. Thus, by reducing the width of the cubes 165*a* and 165*b* provided at opposite distal ends of the receiving region 155 to achieve the narrower water receiving space, uniform ice-making speed of the respective cubes 160 may be accomplished.

The tray 150 is rotated by the tray motor 170 during the ice separating operation to discharge the ice A from the receiving region 155 into the storage container 180. A rotating angle X2 of the tray 150 is in a range of 0° to 150°. The range of the rotating angle X2 may be changed variously in consideration of the tilting angle X1 of the cooling unit 110. The tray 150 may be rotated until the tray 150 comes into contact with the surface of the case 120 of the cooling unit 110.

The ice-full lever 175 is attached to a side surface of the fixing member 177 and serves to sense whether or not the storage container 180 is full of ice. The ice-full lever 175 is vertically movable to sense the presence of ice in the storage container 180 and the sensed information is transmitted to a controller (not shown). The controller (not shown) controls operation of the tray motor 170 based on the information, causing the tray 150 to be rotated in a tilted direction of the cooling unit 110. That is, the operation of the tray motor 170 is linked to operation of the ice-full lever 175.

The fixing member 177 is coupled to the body 10 of the refrigerator and serves not only to receive the tray motor 170 therein, but also to support the ice-full lever 175.

Hereinafter, operation of the ice-making unit according to the embodiment will be described.

Water is filled into the receiving region 155 of the tray 150 through a water supply pipe 15, and refrigerant flowing through the refrigerant pipe 13*a* is moved to the cooling unit 110. In particular, as the refrigerant pipe 112 comes into contact with an inner surface of the cooler 115 of the cooling unit 110, coldness of the refrigerant pipe 112 is directly conducted to the outside, serving to freeze the water in the receiving region 155. Direct conduction of coldness prevents heat and flow losses, achieving enhanced ice-making performance. Moreover, ice is successively formed radially about the cooling unit 110, facilitating discharge of dissolved gas in the water and resulting in improvement in the transparency of ice.

After the ice A is made as described above, the heater 122 is operated and the tray motor 170 is driven to rotate the tray 150 in the tilted direction of the cooling unit 110. As the ice A in the receiving region 155 is brought into contact with the ice-separating members 130 that are kept at fixed positions of the cooling unit 110, the ice A is pushed by the ice separating members 130, thereby being ejected in a direction opposite to a rotating direction of the tray 150 and falling into the storage container 180 to fill the storage container 180.

Once the storage container 180 is full of the ice A, the ice-full lever 175 senses the presence of ice filled in the storage container 180, and the ice separating operation is completed.

Then, if the user attempts to remove the ice via the dispenser 40, the delivery unit 190 and opening/closing device (not shown) are operated to discharge the ice into the discharge region 42 through the ice outlet 183 and ice discharge passage 45. As the ice stored in the storage container 180 is discharged and thus, the storage container 180 is no longer full of ice, water is again supplied into the tray 150 to prepare ice making. The above-described ice making and discharge operations are implemented under the control of the controller (not shown).

Hereinafter, an ice-making unit according to another embodiment will be described in detail with reference to the drawings. A description of the same parts as in the first embodiment will be omitted.

Figure 7:
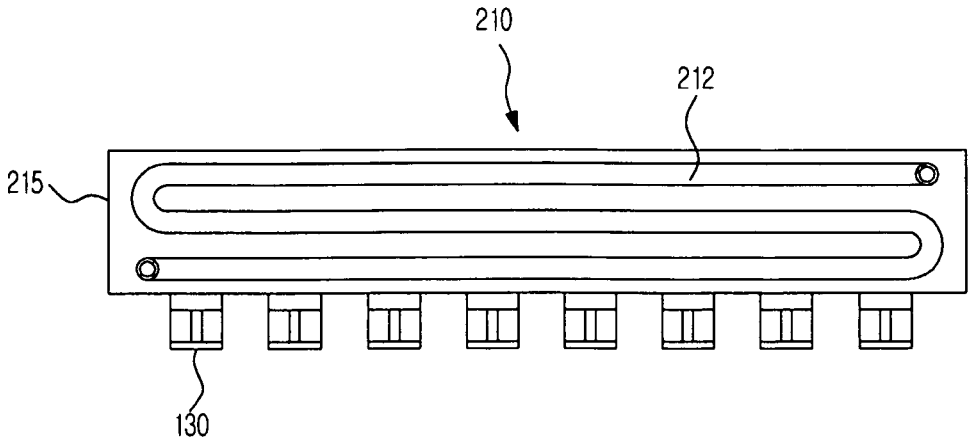
FIG. 7 is a plan sectional view of a cooling unit according to another embodiment.

FIG. 7 is a plan sectional view of a cooling unit according to another embodiment.

A cooling unit 210 in the secondly-described embodiment has the same configuration as the first embodiment with the exception of the arrangement of a refrigerant pipe 212 that comes into contact with an inner surface of a cooler 215. The refrigerant pipe 212 is connected to the evaporator 13 and is placed on the inner surface of the cooler 215 in a serpentine circulating pattern. This arrangement of the refrigerant pipe 212 serves to assure efficient conduction of coldness via the cooler 215.

The operation of the cooling unit 210 according to the second embodiment is identical to that of the first embodiment.

Hereinafter, a refrigerator according to still another embodiment will be described. A description of the same parts as in the first embodiment will be omitted.

Figure 8:
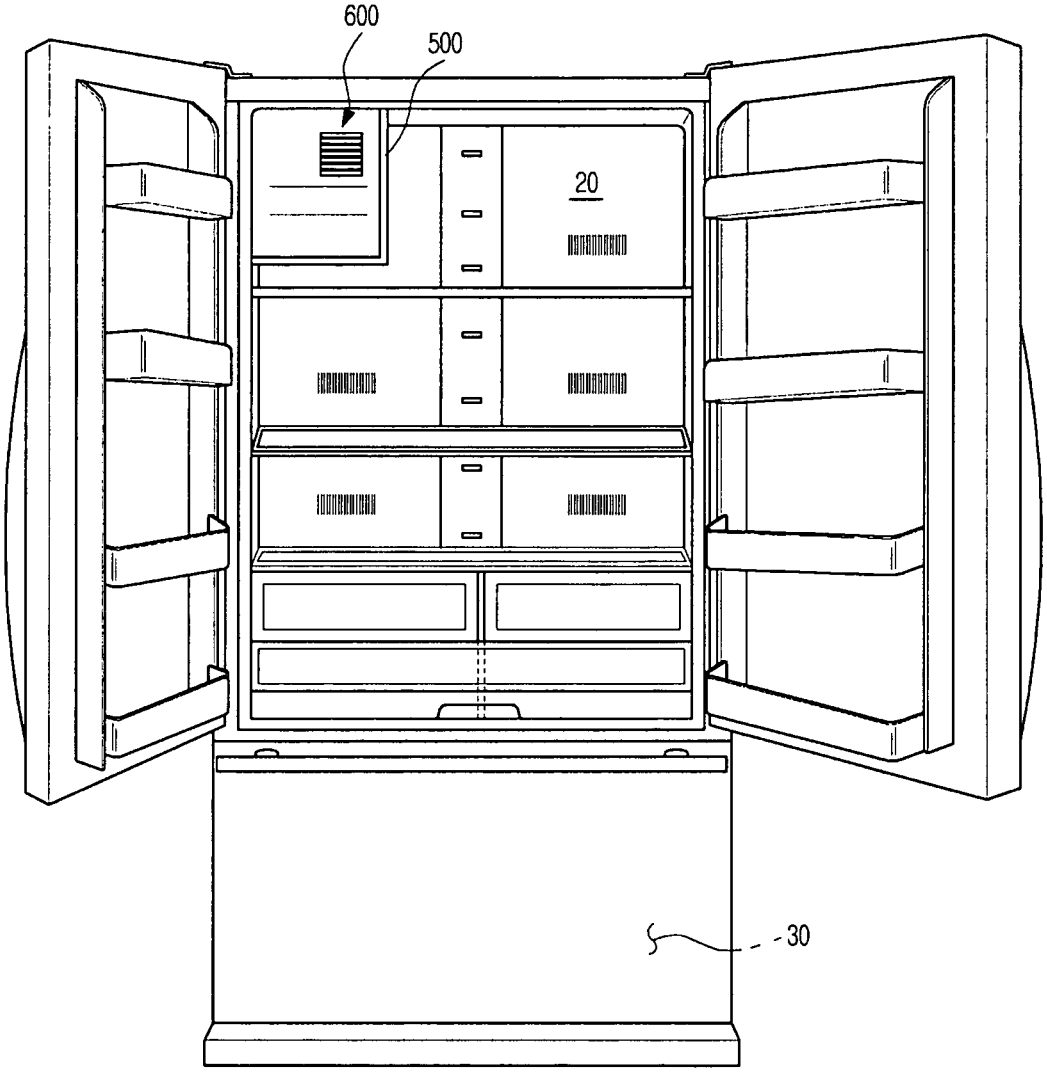
FIG. 8 is a perspective view illustrating the interior of a refrigerator according to a further embodiment.

FIG. 8 is a perspective view illustrating the interior of a refrigerator according to a further embodiment.

As shown in FIG. 8, the refrigerator includes an ice-making chamber 500 separately defined in the refrigerating compartment 20, and an icemaker 600 is placed in the ice-making chamber 500.

Similar to the first embodiment, the icemaker 600 may include the ice-making unit 105, storage container 180, delivery unit 190, and crusher 200, and configurations and functions thereof may be identical to those of the first embodiment.

Specifically, a conventional indirect cooling type ice-making method is greatly affected by a temperature of outside air. Therefore, even if an icemaker is arranged in the refrigerating compartment, the icemaker may exhibit considerable deterioration in ice-making performance under the influence of a temperature of the refrigerating compartment 20. However, the embodiment of FIG. 8 employs a direct cooling type ice-making method and thus, is not greatly affected by a temperature of outside air.

Accordingly, the icemaker 600 may be installed in the refrigerating compartment 20, and effective ice-making using the ice-making unit 105 may be accomplished in the refrigerating compartment 20 as well as the freezing compartment 30.

As is apparent from the above description, a refrigerator according to the embodiment of FIG. 8 is configured such that a cooler provided with a refrigerant pipe comes into direct contact with water to freeze the water into ice. This direct cooling type ice making configuration may result in enhanced ice making performance (i.e. greater ice making capacity and faster ice making speed).

Further, the refrigerator according to the embodiment may accomplish an ice making operation without heat exchange with an evaporator, achieving enhanced operational efficiency without heat and flow losses.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A refrigerator having a body defined by a top wall, bottom wall, side walls, rear wall, an inner partition wall to divide the body into refrigerating and freezing storage compartments, open front sides, doors to open or close the open front sides of the storage compartments, an ice-making unit provided in one of the storage compartments, and a dispenser to discharge ice made in the ice-making unit, the ice-making unit comprising:

a cooling unit in which a refrigerant pipe is received; and a tray having a receiving region, wherein a lower lateral end of the cooling unit is placed in the receiving region and comes into contact with water received in the receiving region to make the ice, wherein an upper lateral end of the cooling unit is fixed to a corner of the body of the refrigerator where the top wall meets the real wall, whereby a centerline of the cooling unit extending between the lower and the upper lateral ends of the cooling unit is inclined at a predetermined angle relative to the top wall to facilitate the ice discharged from the receiving region by rotating the tray.

2. The refrigerator according to claim 1, wherein:

the cooling unit comprises a case defining an external appearance of the cooling unit, and a cooler to conduct coldness to the receiving region; and the refrigerant pipe is arranged inside the cooler.

3. The refrigerator according to claim 2, wherein the cooler is located at the lower lateral end the cooling unit, and the tray is located under the cooler.

4. The refrigerator according to claim 3, wherein:

each of the cooler and receiving region has a curvature; and the curvature of the cooler is similar to the curvature of the receiving region, so that the cooler comes into contact with the refrigerant pipe to conduct coldness to the receiving region.

5. The refrigerator according to claim 3, wherein:

each of the cooler and receiving region has a curvature; and the cooler and receiving chamber have the same center of curvature.

6. The refrigerator according to claim 2, wherein the cooler contains at least one of thermally conductive metal and plastic.

7. The refrigerator according to claim 6, wherein the metal includes at least one of aluminum and copper.

8. The refrigerator according to claim 2, wherein the cooler comprises a coating layer.

9. The refrigerator according to claim 8, wherein:

the cooling unit comprises an ice-separating member to eject the ice;

the ice-separating member is arranged to come into contact with the ice by rotation of the tray; and the ice is pushed by the ice-separating member when the tray is rotated and is ejected in a direction opposite to a rotating direction of the tray.

10. The refrigerator according to claim 9, wherein a rotating angle of the tray is in a range of 0° to 150°.

11. The refrigerator according to claim 1, wherein the refrigerant pipe arranged in the cooling unit is wound into multiple layers to circulate the refrigerant within the interior of the cooling unit.

12. The refrigerator according to claim 1, wherein the refrigerant pipe arranged in the cooling unit has a serpentine circulating pattern.

13. The refrigerator according to claim 1, further comprising a tray motor to rotatably drive the tray.

14. The refrigerator according to claim 13, further comprising a controller to cause the tray to be rotated in a tilted direction of the cooling unit for an ice separating operation.

15. The refrigerator according to claim 14, wherein an ice-separating member is provided at an upper side of the cooler of the cooling unit.

16. The refrigerator according to claim 11, further comprising a storage container and an ice-full lever to sense whether or not the storage container, in which the ice discharged from the ice-making unit is stored, is full of the ice, wherein operation of the tray motor is linked to operation of the ice-full lever.

17. The refrigerator according to claim 1, wherein:

the receiving region comprises a plurality of partitions to divide the region into a plurality of shapes; and two of the plurality of shapes located at opposite distal ends of the receiving region have narrower water receiving spaces than a remaining number of the plurality of shapes.

18. The refrigerator according to claim 1, wherein the cooling unit comprises a heater for separation of the ice.

19. The refrigerator according to claim 1, wherein the cooling unit comprises a heat insulating material filled therein.

20. The refrigerator according to claim 1, wherein the tray is located under the cooling unit during an ice making operation, and is located at a lateral side of the cooling unit during an ice separating operation.

21. The refrigerator according to claim 1, wherein the ice-making unit is provided at a side position of the refrigerating compartment.

22. The refrigerator according to claim 1, wherein the refrigerator includes a separate ice-making chamber in the refrigerating compartment, and the ice-making unit is provided in the ice-making chamber.

* * * * *